United States Patent [19]

Jennings

[11] 4,241,715

[45] Dec. 30, 1980

[54] COMPOUND BOW WITH ADJUSTABLE ECCENTRIC WHEEL

[75] Inventor: Thomas P. Jennings, Sun Valley, Calif.

[73] Assignee: Jennings Compound Bow, Inc., Valencia, Calif.

[21] Appl. No.: 961,760

[22] Filed: Nov. 17, 1978

[51] Int. Cl.[3] ..... F41B 5/00

[52] U.S. Cl. ..... 124/24 R

[58] Field of Search ..... 124/24 R, 23 R, 90, 124/86; 242/155 R, 154, 75

[56] References Cited

U.S. PATENT DOCUMENTS

| | | | |
|---|---|---|---|
| 4,064,862 | 12/1977 | Groner | 124/23 R |
| 4,078,538 | 3/1978 | Shepley | 124/24 R |
| 4,079,723 | 3/1978 | Darlington | 124/24 R |
| 4,112,909 | 9/1978 | Caldwell | 124/23 R |

OTHER PUBLICATIONS

Jennings Two-Wheel Compounds—Archery Magazine, Aug. 1976 issue, p. 13—Jennings Compound Bow, Inc.

*Primary Examiner*—Richard C. Pinkham
*Assistant Examiner*—William R. Browne
*Attorney, Agent, or Firm*—Charles H. Schwartz

[57] ABSTRACT

A compound bow, including a center handle portion, upper and lower limbs respectively attached to the upper and lower ends of the handle portion and having resilient properties, a bow string, a pair of draw cables, and coupling the bow string between the draw cables to provide a continuity between the bow string and the draw cables, a pair of draw pulleys each constructed to receive an individual one of the draw cables and each operatively coupled to an individual one of the limbs at a position near the end of the associated limb, each of the draw cables having a peripheral portion and a central portion, first and second spaced grooves in the peripheral portion and a path leading through the central portion and connecting the first and second grooves, and with the path intersecting the first and second grooves at particular points and each of the draw pulleys permitting variations of the point of intersection between the path and at least one of the first and second grooves for providing an adjustment in the draw length and the draw weight of the bow.

12 Claims, 9 Drawing Figures

20
56
16
28
12
24
26
10
25
14
30
18
58
22

52
50
54
36
32
30
34
42
40
46
44
48

54
52
32
50
36
38
34
16
46
44
48
42

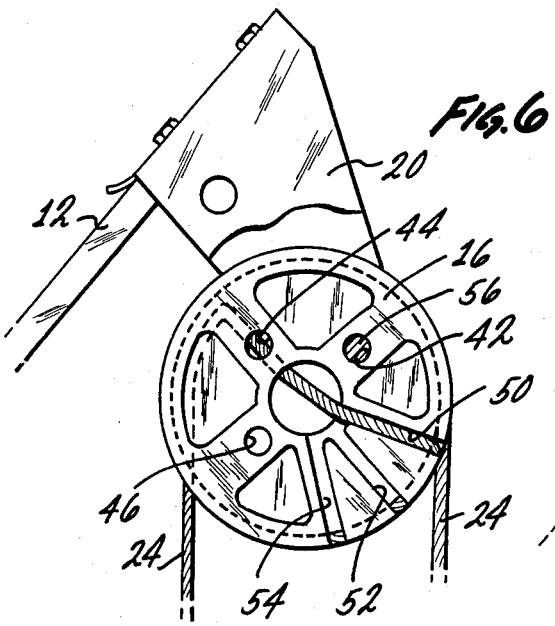
FIG. 6
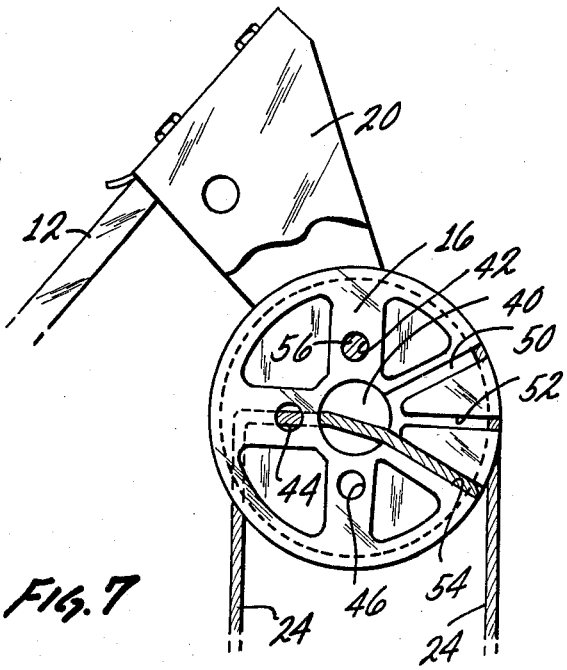
FIG. 7
FIG. 8
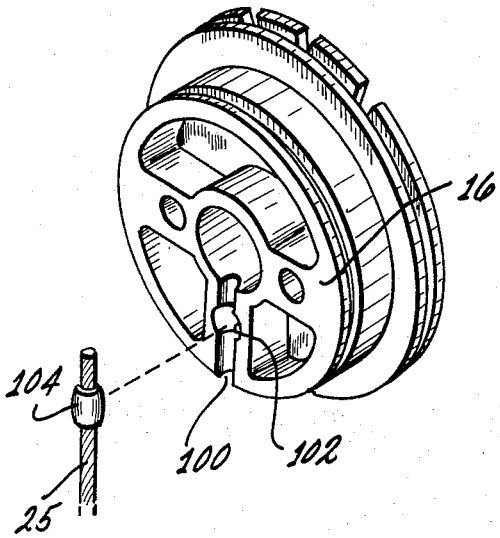
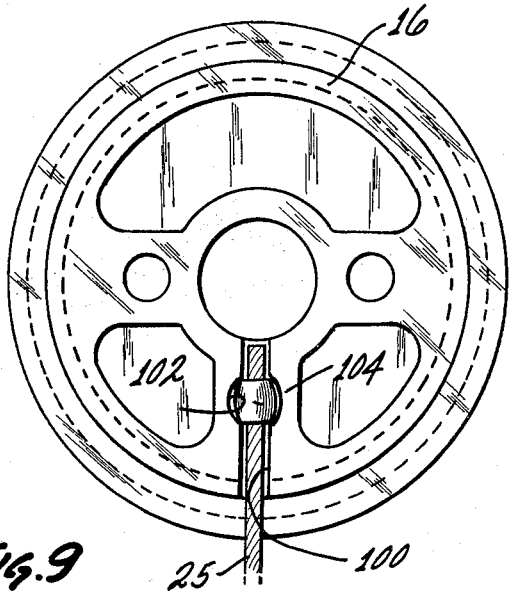
FIG. 9

COMPOUND BOW WITH ADJUSTABLE ECCENTRIC WHEEL

The present invention is directed to an improvement in a compound bow and in particular an improved adjustable eccentric pulley, for use with a compound bow.

Generally compound bows presently on the market use eccentric pulleys as a part of their design. The operation of the compound bow is generally well known and the eccentric pulleys used with such compound bows generally provide for a single cable position. This single cable position is generally fixed and does not allow for any provision for cable adjustments. If it is desired to change the draw weight or the draw length of the compound bow, this is normally accomplished either by substituting different eccentric pulleys or by physically changing the cable length or by providing for adjustment between the limbs and the handle.

The above methods of making adjustments of the draw weight and draw length are either lacking in range of adjustment or are relatively complicated and cumbersome. The present invention provides for eccentric wheels which have an adjustable path position for the cable around the pulley so as to provide the archer added flexibility in adjustment of draw length and draw weight. Specifically the path position is adjustable to fixed positions so that the draw weight and length can be varied to fixed values by changing the cable position and a resultant pre-rotation for each of the eccentrics.

As a specific example, the eccentric may include three fixed positions with the short draw range cable position providing for the bow having a draw length and peak weight at minimum values and with the long draw range position providing for the draw length and peak weight at maximum values. A middle position is also provided which allows for the values of the draw length and peak weight to be intermediate to the values provided by the other positions. The cable position through the eccentrics is easily changed from one fixed position to another position so that the bow is very versatile and can be easily adjusted to accomodate different draw lengths and peak weights, depending upon the desirability of the archer.

A clearer understanding of the invention will be had with reference to the following description and drawings wherein:

FIG. 6 illustrates a side view of one end portion of the bow and with the cable in one extreme cable position through the eccentric wheel of the present invention.

FIG. 7 illustrates a side view of one end portion of the bow and with the cable in the other extreme cable position through the eccentric wheel of the present invention.

FIG. 8 illustrates a perspective view of the eccentric wheel of the present invention illustrating an alternative method of anchoring an end of the cable.

FIG. 9 illustrates a side view of the wheel of FIG. 8.

The present invention provides for an improvement in a compound bow such as the type shown in U.S. Pat. No. 4,112,909, issued Sept. 12, 1978, listing Joseph Caldwell as the inventor and assigned to the same assignee as the present application. In particular the present invention provides for an improved eccentric wheel having fixed positions for providing adjustments in the draw weight and draw length.

Figure 1:
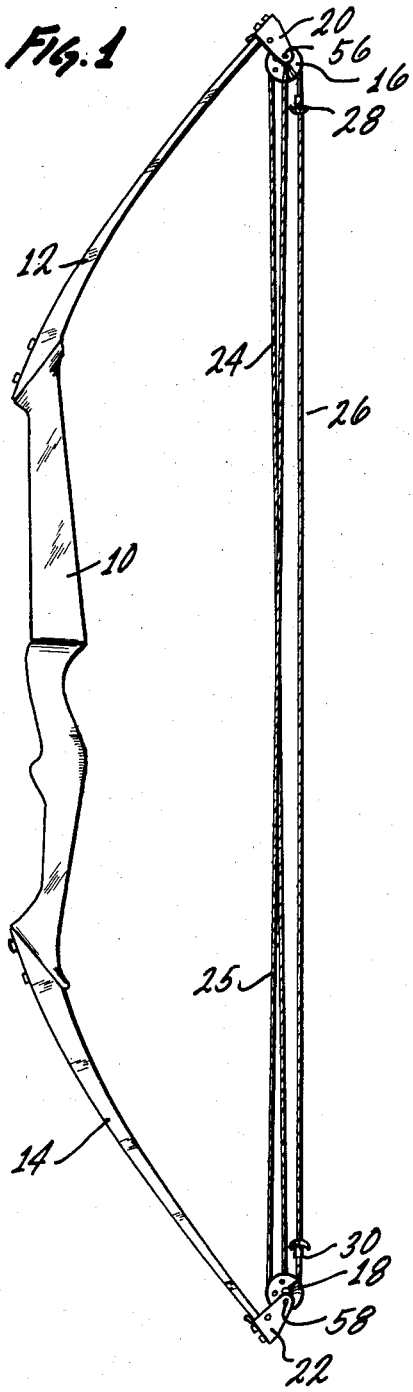
FIG. 1 illustrates a two wheel compound bow using a closed cable system.

As shown in FIG. 1, the eccentric wheel of the present invention may be used with a compound bow of the type shown in FIG. 1 but it is to be appreciated that the eccentric wheel of the present invention may be used with other types of compound bows. Generally, the compound bow of FIG. 1 includes a handle portion 10 and a pair of limbs 12 and 14 supported at the ends of the handle 10. Eccentric wheels 16 and 18 are rotatably mounted at the tips of the limbs 12 and 14 within U-shaped hangers 20 and 22. A pair of cables 24 and 25 are wound around the eccentric wheels 16 and 18 in a particular manner which will be explained with reference to the following Figures.

A bow string 26 is attached to the ends of the cables 24 and 25 and specifically the bow strings are attached to bowstring holders 28 and 30 which are supported at the ends of the cables.

Figure 2:
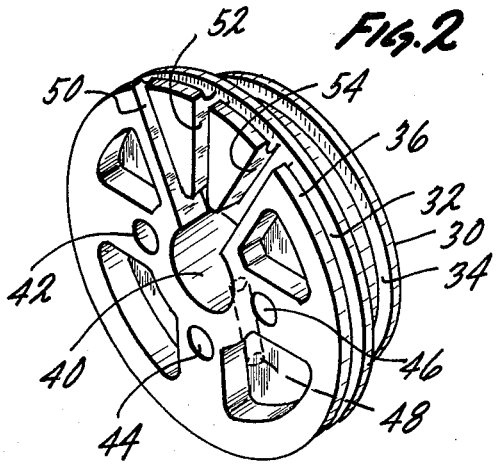
FIG. 2 illustrates a perspective view of an eccentric constructed in accordance with the teachings of the present invention and including three-fixed cable positions.
Figure 3:
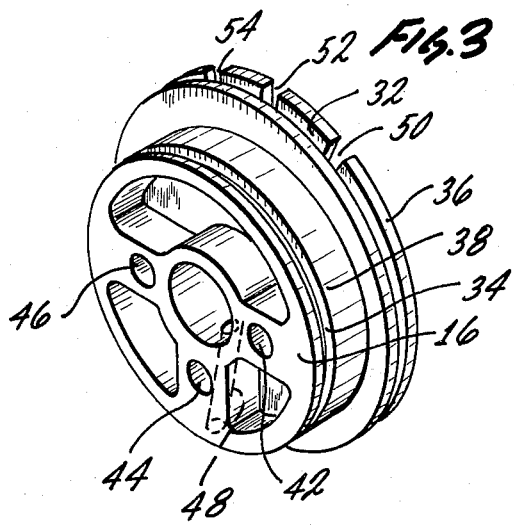
FIG. 3 illustrates a perspective view of the eccentric of FIG. 2 from the side opposite to FIG. 2.

FIGS. 2 and 3 illustrate perspective views of one eccentric wheel 16 but it is to be appreciated that the other eccentric wheel 18 is substantially identical and a description of one eccentric wheel will serve to describe both. The eccentric wheel 16 includes parallel grooves 32 and 34, which grooves receive and support the cable 24. The grooves are contained in circumferential peripheral portions of the wheel 16 and specifically groove 32 is contained in a peripheral portion 36 while the groove 34 is contained in a peripheral portion 38. It can be seen that the peripheral portion 36 has a larger diameter than the peripheral portion 38 but it is to be appreciated that the diameters for the two portions may be the same.

The wheel 16 includes a large central opening 40 extending through the wheel. In addition, a plurality of openings 42, 44 and 46 offset to the central opening extend through the wheel. A passageway 48 extends from one side of the central opening 40 and terminates in the groove 34. This passageway is used to provide a path for the cable 24 as will be explained and shown in a later portion of this specification. The wheel 16 also includes a plurality of radial slots which extend between the central opening 40 and the groove 32. Specifically three such slots 50, 52 and 54 are shown to extend radially between the opening 40 and the groove 32. Other portions of the eccentric wheel 16 are shown to be relieved so as to lighten the weight of the wheel and also allow for the wheel to be balanced.

It can be seen that the combination of any one of the slots 50, 52 or 54 plus the central opening 40 and the passageway 48 provides for a path from the groove 32 to the groove 34. Depending upon which one of the slots 50, 52 or 54 is used, the path can be changed to one of three fixed positions.

Figure 4:
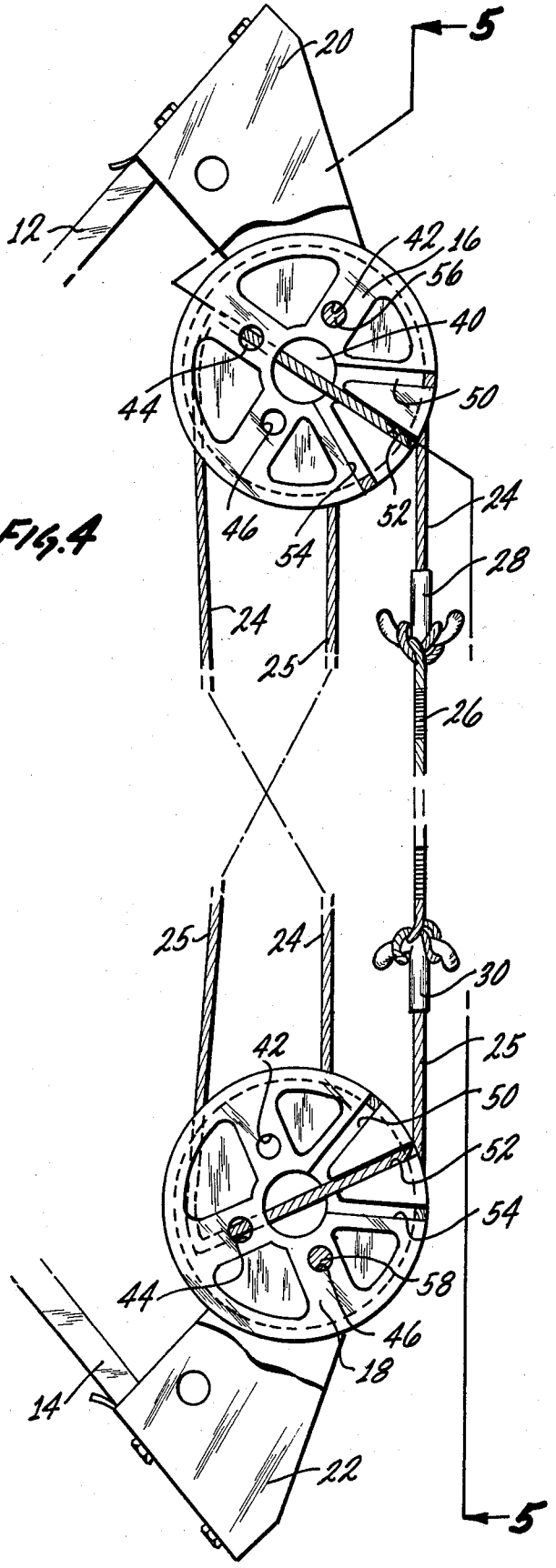
FIG. 4 illustrates a detailed side view partially broken away of the end portions of the bow of FIG. 1 showing the eccentrics of the present invention mounted within hangers mounted at the ends of the limbs.
Figure 5:
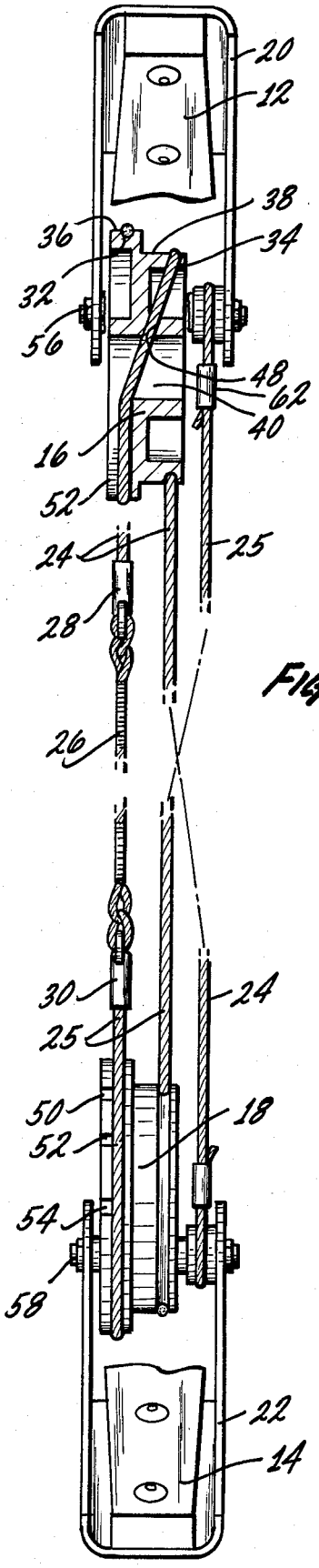
FIG. 5 is an end view partially in cross section of the bow of FIG. 4 taken along the lines 5—5 of FIG. 4.

As shown in FIGS. 4 and 5, the eccentric wheels are mounted at the tips of the limbs 12 and 14 through the use of U-shaped hangers 20 and 22. As indicated above the wheels 16 and 18 are substantially identical and the major difference is that the wheel 16 is pivotally mounted within the hanger 20, using a shaft member 56 extending through opening 42. The eccentric wheel 18 is pivotally mounted within the hanger 22 through the use of a shaft member 58 extending through opening 46.

As shown in FIGS. 4 and 5 the cable 24 extends from the holder 28 and lies within the groove 32 to pass around the peripheral portion 36 of the wheel 16. The cable than is bent substantially at right angles to lie within the radial slot 52. The cable 24 passes from the radial slot 52 and into the central opening 40. The cable 24 extends across the central opening 40 at a slight angle and enters and passes through the passage way 48. The cable 24 exits the passageway 48 at a right angle and is received within the groove 34 in the peripheral portion 38. The cable actually lies within the groove 34 for a short distance before extending across the bow. The cable is received at the tip of the other limb 14 and specifically is anchored around the shaft 58 by an anchoring device 60. The cable 25 is similarly wound around and through the wheel 18 and is anchored at the tip of the limb 12 by an anchoring device 62.

As shown in FIGS. 4 and 5 and assuming a particular length for the cables 24 and 25 and the bow string 26, the draw weight and draw length is determined by the total length of the cables since the length of the cables determine the initial loading of the limbs at the braced position. It is to be appreciated that compound bows such as the type shown in FIG. 1 normally include adjustments in the draw length and draw weight such as by changing the relationship between the limbs 12 and 14 and the handle. However the present invention provides for eccentric wheels which incorporate an adjustment feature, which adjustment feature may be in lieu of other methods of adjustment or may be in addition to other methods of adjustment.

As shown in FIGS. 4 and 5 the wheels 16 and 18 have the cables 24 and 25 wrapped around them and in a middle adjustment position since the cables pass through the center radial slot 52. FIGS. 6 and 7 show the cable 24 positioned around the wheel 16 and with the cable 24 in the short draw cable position in FIG. 6 and in the long draw cable position in FIG. 7. In FIG. 6 the cable 24 passes through the radial slot 50 before entering the opening 40 and in this position the draw length and peak weight of the bow will be reduced. In FIG. 7 which is the long draw cable position with the cable 24 in slot 54, the draw length and peak weight will be increased. These changes in draw length and weight occur because the position of the cable in one of the different slots 50, 52 and 54 provides for different prerotations of the eccentric wheel in the braced position. Whatever cable position is used for the wheel 16, the complementary position is used for the cable 25 in the wheel 18 so that the bow is in balance.

The eccentric wheels of the present invention therefore provide for a plurality of fixed adjustments of the draw length and draw weight. These adjustments may be used in conjunction with other adjustments provided in the bow so as to produce different ranges of adjustment. For example, as shown in the present invention, three fixed positions are provided and each position represents a medium point for a range through which the draw length and weight may be adjusted depending upon the other adjustment features of the bow.

As shown in FIG. 5 the ends of the cable 24 are anchored by anchor devices 60 and 62. FIGS. 8 and 9 illustrate an alternate type of anchoring device which may be incorporated within the eccentric wheel. Specifically as shown in FIGS. 8 and 9, the eccentric wheel 16 may include a slot 100 having an enlarged portion 102. The end of the cable 25 may include an anchor device 104 which has an outer configuration matching that of the enlarged portion 102. As shown in FIG. 2 the anchor device 104 fits within the enlarged portion 102 and provides for an anchoring of the end of the cable 25.

It is to be appreciated that the present invention is shown with reference to a compound bow having a two wheel system but the eccentric wheel of the present invention may also be used with other types of compound bows such as those having a four wheel system. Although the invention has been shown with reference to a particular embodiment it is to be appreciated that other adaptations and modifications may be made and the invention is only to be limited by the appended bows.

I claim:

1. In a compound bow having a center handle portion, upper and lower limbs having inner ends connected to the center portion and free outer ends, and upper and lower draw pulleys mounted for eccentric rotation respectively on the free outer ends of the upper and lower limbs and with first and second draw cables each having one end secured to opposite limbs and each having a free end passing across the bow to the opposite limb and around one of the draw pulleys and with a bow string interconnecting the free ends of the first and second draw cables, the improvement comprising each of the draw pulleys having a peripheral portion and a central portion, first and second spaced grooves formed in and extending around the peripheral portion, a path leading through the central portion and connecting the first and second grooves and with the path intersecting the first and second grooves at particular points, the first draw cable passing into contact with and lying within the first groove in the peripheral portion and then passing along the path leading through the central portion and passing into contact with the second groove, the second draw cable passing into contact with the first groove on the other draw pulley, and then passing along the path leading through the central portion and then passing into contact with the second groove, and means for permitting variations of the point of intersection between the path and at least one of the first and second spaced grooves for adjusting the draw length and draw weight of the bow.

2. In the compound bow of claim 1, wherein the means for permitting variations of the point of intersection provides a plurality of fixed points of intersection for producing fixed adjustments of draw length and draw weight.

3. In the compound bow of claim 1, wherein the means for permitting variations of the point of intersection are a plurality of predetermined slots extending from different peripheral points of the first groove to the central portion.

4. In the compound bow of claim 3, additionally including an internal passageway leading from the central portion to the second groove and providing a portion of the path between the first and second grooves.

5. In the compound bow of claim 1, additionally including an internal passageway leading from the central portion to the second groove and providing a portion of the path between the first and second grooves and wherein the means for permitting variations of the point of intersection provides a plurality of fixed points of intersection for producing fixed adjustments of draw length and draw weight.

6. In the compound bow of claim 1, wherein the ends of the draw cables secured to opposite limbs are secured within openings in the draw pulleys mounted on the ends of the limbs and with the openings each including an enlarged portion and with the ends of each cable including an anchor member and with each anchor member received within one of the enlarged portions.

7. A compound bow, including a center handle portion, upper and lower limbs respectively attached to the upper and lower ends of the handle portion and having resilient properties, a bow string, a pair of draw cables, means for coupling the bow string and the draw cables to provide a continuity between the bow string and the draw cables, a pair of draw pulleys each operatively coupled to an individual one of the limbs at a position near the end of the associated limb, each of the draw pulleys having a peripheral portion and a central portion, first and second spaced grooves formed in and extending around the peripheral portion for receiving one of the pair of draw cables, a path for the one of the draw cables leading through the central portion and connecting the first and second grooves and with the path intersecting the first and second grooves at particular points, and each of the draw pulleys including means for permitting variations of the point of intersection between the path and at least one of the first and second grooves for providing an adjustment in the draw length and draw weight of the bow.

8. The compound bow of claim 7, wherein the means for permitting variations of the point of intersection provides a plurality of fixed points of intersection for producing fixed adjustments of draw length and draw weight.

9. The compound bow of claim 7, wherein the means for permitting variations of the point of intersection are a plurality of predetermined slots extending from different peripheral points of the first groove to the central portion.

10. The compound bow of claim 9 additionally including an internal passageway leading from the central portion to the second groove and providing a portion of the path between the first and second grooves.

11. The compound bow of claim 7 additionally including an internal passageway leading from the central portion to the second groove and providing a portion of the path between the first and second grooves and wherein the means for permitting variations of the point of intersection provides a plurality of fixed points of intersection for producing fixed adjustments of draw length and draw weight.

12. The compound bow of claim 7, wherein the ends of the draw cables are secured to opposite limbs and are secured within openings in the draw pulleys mounted on the ends of the limbs and with the openings each including an enlarged portion and with the ends of each cable including an anchor member and with each anchor member received within one of the enlarged portions.

* * * * *